US006903509B2

(12) United States Patent
Kanzaki

(10) Patent No.: US 6,903,509 B2
(45) Date of Patent: Jun. 7, 2005

(54) ULTRAHIGH PRESSURE DISCHARGE LAMP OF THE SHORT ARC TYPE WITH IMPROVED METAL FOIL TO ELECTRODE CONNECTION ARRANGEMENT

(75) Inventor: Yoshitaka Kanzaki, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 170 days.

(21) Appl. No.: 10/376,482

(22) Filed: Mar. 3, 2003

(65) Prior Publication Data

US 2003/0168981 A1 Sep. 11, 2003

(30) Foreign Application Priority Data

Mar. 5, 2002 (JP) ..... 2002-059347

(51) Int. Cl.[7] ..... H01J 17/18; H01J 5/50; H01J 61/20; H01J 9/18; H01J 9/32

(52) U.S. Cl. ..... 313/631; 313/570; 313/571; 313/623; 313/626; 313/631; 313/639

(58) Field of Search ..... 313/570, 571, 313/623, 626, 631, 639

(56) References Cited

U.S. PATENT DOCUMENTS

| | | | | |
|---|---|---|---|---|
| 3,675,068 A | * | 7/1972 | Strauss | 313/623 |
| 3,714,493 A | * | 1/1973 | Fridrich | 313/571 |
| 4,959,587 A | * | 9/1990 | Schug | 313/623 |
| 5,109,181 A | | 4/1992 | Fischer et al. | |
| 5,430,353 A | * | 7/1995 | Feldman et al. | 313/623 |
| 5,497,049 A | | 3/1996 | Fischer | |
| 6,181,064 B1 | * | 1/2001 | Narita | 313/623 |
| 2003/0076040 A1 | * | 4/2003 | Kumada et al. | 313/631 |
| 2003/0107320 A1 | * | 6/2003 | Kanzaki et al. | 313/623 |

FOREIGN PATENT DOCUMENTS

| | | |
|---|---|---|
| JP | 55-046456 | 4/1980 |
| JP | 11-016539 | 1/1999 |
| JP | 11-176385 | 7/1999 |
| JP | 2000-164172 | 6/2000 |

* cited by examiner

*Primary Examiner*—Nimeshkumar D. Patel
*Assistant Examiner*—Elizabeth Rielley
(74) *Attorney, Agent, or Firm*—Nixon Peabody LLP; David S. Safran

(57) ABSTRACT

An arrangement with a relatively high pressure tightness in a super-high pressure mercury lamp which is operated with an extremely high mercury vapor pressure is achieved in accordance with the invention in a super-high pressure discharge lamp of the short arc type having a light emitting part in which a pair of electrodes are disposed opposite each other and which is filled with at least 0.15 mg/mm$^3$ mercury; and side tube parts which extend from each side of the light emitting part and in each of which a respective one of the electrodes is partially hermetically sealed and is connected to a metal foil, by the area of the respective metal foil which is connected to the respective electrode has a smaller width than the width in the remaining area of the metal foil, the area with the smaller width wrapping at least partially around the outside surface of the electrode.

12 Claims, 8 Drawing Sheets

ULTRAHIGH PRESSURE DISCHARGE LAMP OF THE SHORT ARC TYPE WITH IMPROVED METAL FOIL TO ELECTRODE CONNECTION ARRANGEMENT

BACKGROUND OF THE INVENTION

1. Field of the Invention

The invention relates to an ultrahigh pressure discharge lamp of the short arc type in which the mercury vapor pressure during operation is at least 150 atm. The invention relates especially to an ultrahigh pressure discharge lamp of the short arc type which is used as the back light of a liquid crystal display and for a projector device using a DMD, such as a DLP or the like.

2. Description of Related Art

In a projector device of the projection type, there is a demand for illumination of images onto a rectangular screen in a uniform manner and moreover with adequate color reproduction. Therefore, the light source is a metal halide lamp which is filled with mercury and a metal halide. Furthermore, recently smaller and smaller metal halide lamps, and more and more often point light sources have been produced and lamps with extremely small distances between the electrodes, have been used in practice.

Against this background, instead of metal halide lamps, lamps with an exceptionally high mercury vapor pressure, for example, with 150 atm, have been suggested recently. Here, the increased mercury vapor pressure suppresses broadening of the arc (the arc is contracted) and a clear increase of the light intensity is the goal. Such an ultrahigh pressure discharge lamp is disclosed, for example, in Japanese patent disclosure document JP HEI 2-148561 (U.S. Pat. No. 5,109,181) and in Japanese patent disclosure document JP HEI 6-52830 (U.S. Pat. No. 5,497,049).

In such an ultrahigh pressure discharge lamp, the pressure within the arc tube during operation is extremely high. In the side tube parts which extend from each side of the arc tube portion, it is therefore necessary to place the silica glass of which these side tube parts are formed, the electrodes and the metal foils for power supply sufficiently, and moreover, tightly, directly adjoining one another. If they are not arranged tightly adjoining one another, the added gas escapes or cracks form. In the process of hermetic sealing of the side tube parts, therefore, the silica glass is heated, for example, at a high temperature of 2000° C., and in this state, the silica glass with high thickness is gradually subjected to shrinking. In this way, the adhesive property of the side tube parts is increased.

However, if the silica glass is heated to an unduly high temperature, the defect arises that, after completion of the discharge lamp, the side tube parts are often damaged, even if the adhesive property of the silica glass on the electrodes or the metal foils is increased.

This defect is caused by the following:

After heat treatment, in the stage in which the temperature of the side tube parts is gradually reduced, as a result of the differences between the coefficient of expansion of the material of the electrodes (tungsten), and the coefficient of expansion of the material of the side tube parts (silica glass), there is a relative difference of the amount of expansion. This causes cracks to form in the area in which the two come into contact with one another. These cracks are extremely small. However, during lamp operation, together with the ultrahigh pressure state during operation, they lead to crack growth; this causes damage to the discharge lamp.

In order to eliminate this disadvantage, an arrangement as shown in FIG. 9 is suggested. In the figure, the light emitting part 2 of a discharge lamp 1 is adjoined by the side tube parts 3. The tips of an electrode 6 and an electrode 7 project into the light emitting part 2 and on their respective ends, hereinafter also called the upholding parts of the electrodes, the electrodes are each connected to a metal foil 8. A respective coil component 10 is wound around the areas of the electrodes 6, 7, which are installed in the side tube parts 3. This arrangement reduces the stress which is exerted on the silica glass by the coil components 10 which have been wound around the upholding parts of the electrodes as a result of the thermal expansion of the (upholding parts of the) electrodes. This arrangement is described, for example, in Japanese patent disclosure document HEI 11-176385.

However, in reality, there was the disadvantage that, in the vicinity of the electrodes 6, 7 and the coil components 10, there remain cracks, even when the thermal expansion of the electrodes is accommodated by one such arrangement. These cracks are admittedly very small, but there are often cases in which they lead to damage of the side tube parts 3 when the mercury vapor pressure of the light emitting part 2 is roughly 150 atm. Furthermore, in recent years, there has been a demand for a very high mercury vapor pressure of 200 atm and beyond to 300 atm. At this high mercury vapor pressure during operation, the growth of cracks is accelerated. As a result, there was the disadvantage that noticeable damage to the side tube parts 3 occurs. This means that the cracks grow gradually during lamp operation with a high mercury vapor pressure, even if they were extremely small at the start.

It can be stated that the avoidance of cracks under these conditions is a new technical object which was never present in a mercury lamp with a vapor pressure during operation of roughly 50 atm to 100 atm.

SUMMARY OF THE INVENTION

The present invention was devised to eliminate the aforementioned defects of the prior art. The object of the invention is to devise an arrangement with relatively high pressure tightness in a ultrahigh pressure mercury lamp which is operated with an extremely high mercury vapor pressure.

The object is achieved in accordance with the invention, in a super-high pressure discharge lamp of the short arc type which comprises:

- a light emitting part in which there are a pair of electrodes opposite and which is filled with at least 0.15 mg/mm$^3$ mercury, and
- side tube parts which extend to each side of the light emitting part, in which a section of the respective electrode is hermetically sealed and in which the electrodes are each connected to a metal foil, by the area of the respective metal foil to which the electrode is connected having a reduced width and being made such that it cradles a portion of the outside surface of the electrode.

Furthermore, the object is achieved by the metal foils being welded to the electrodes and the welding sites having at least two weld tracks which are formed by welding from the horizontal direction of the above described metal foils.

The object is also achieved in that the above described metal foils having a cross section of wider area that is essentially Ω-shaped outside the area with the reduced width.

Additionally, the object is achieved by the above described metal foils having a cross section of wider area that is essentially W-shaped outside the area with the reduced width.

In the ultrahigh pressure discharge lamp of the short arc type in accordance with the invention, the above described arrangement, by reducing the gap in the respective side tube part, seeks to further suppress the formation and growth of extremely small cracks.

As is shown in FIG. 10, the inventor has found that, in the area of the side tube part in which the metal foil is welded to the electrode, a gap X inevitably occurs between the metal foil 8 and the electrode 7. The inventor found that an extremely high pressure within the light emitting part acts directly on this gap X and influences the formation and growth of cracks.

The inventor considered that the measure of winding the electrodes with coil components, and thus, the advantageous relief of the difference of the coefficient of thermal expansion between the two which was described in the prior art did not inherently eliminate the presence of such a gap X, and therefore, that formation, growth and an increase in the size of the cracks are caused.

In the invention, by the above described new arrangement, in the respective side tube part, the electrode and the metal foil can be advantageously welded to one another, and moreover, the gap X can be kept extremely small. In practice, it can be suppressed to a degree in which it hardly forms.

The invention is further described below using several embodiments shown in the drawings.

DETAILED DESCRIPTION OF THE INVENTION

Figure 1:
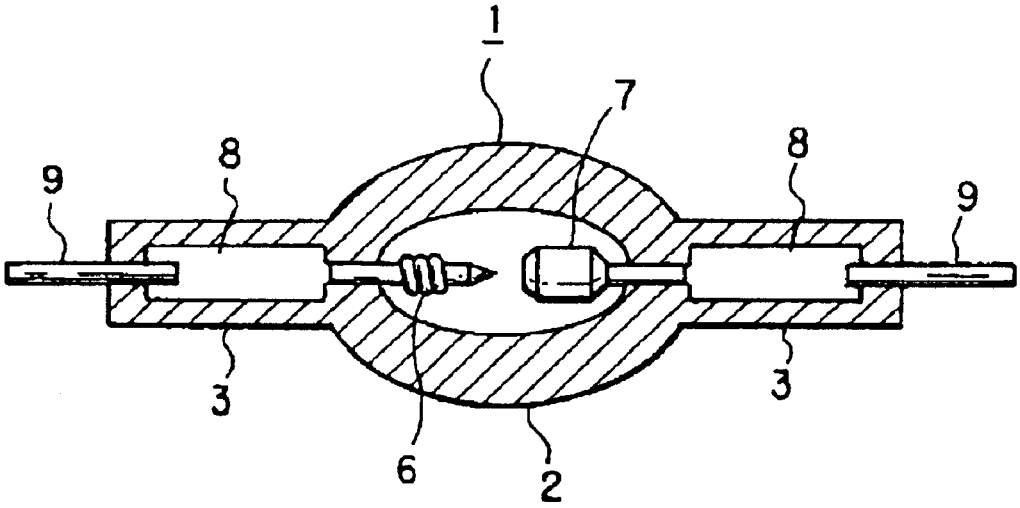
FIG. 1 is a cross-sectional view of an ultrahigh pressure discharge lamp of the short arc type in accordance with the invention.

FIG. 1 shows the overall arrangement of an ultrahigh pressure discharge lamp in accordance with the invention (hereinafter, also called only a "discharge lamp"). In the figure, a discharge lamp 1 has an essentially spherical light emitting part 2 which is formed by a silica glass discharge vessel. Within this light emitting part 2 there are a cathode electrode 6 and an anode electrode 7 disposed opposite on another. A side tube part 3 extends from each the opposite ends of the light emitting part 2. A conductive metal foil 8, which is usually made of molybdenum, is hermetically arranged, for example, by a shrink seal in each side tube part 3. The ends of the cathode and anode electrodes 6, 7 are each located on an end of a respective one of the metal foils 8, and are welded on in this state so as to be are electrically connected to them. An outer lead 9 is welded to the other end of the respective metal foil 8 and projects to out of the side tube part 3. There is certainly a case in which the cathode and anode electrodes 6, 7 each differ from the rod-shaped part in which they are connected to the metal foils. However, in accordance with the invention, the term "electrode" is defined as a part which also includes the rod-shaped part, if not stated otherwise.

The light emitting part 2 is filled with mercury, a rare gas and a halogen gas. The mercury is used to obtain the required wavelength of visible radiation, for example, to obtain radiant light with wavelengths from 360 nm to 780 nm, and is added in an amount of at least 0.15 mg/mm$^3$ of the inside volume of the light emitting part 2. This added amount also differs depending on the temperature condition. However, during operation, a pressure of at least 150 atm, therefore, an extremely high vapor pressure, is reached. By adding a larger amount of mercury, a discharge lamp with a high mercury vapor pressure during operation of at least 200 atm or 300 atm can be produced. The higher the mercury vapor pressure, the more suitable the light source for a projector device which can be realized.

The rare gas is, for example, roughly 13 kPa of argon gas, by which the operating starting property is improved.

The halogen is iodine, bromine, chlorine and the like in the form of a compound with mercury and other metals. The amount of halogen added can be selected, for example, from the range $10^{-6}$ to $10^{-2}$ $\mu$mol/mm$^3$ . The function of the halogen is to prolong the service life using the halogen cycle. For an extremely small discharge lamp with a high internal pressure, such as the discharge lamp in accordance with the invention, it can be expected that adding of halogen influence damage due to devitrification of the discharge vessel.

The numerical values of such a discharge lamp are shown below by way of example:

the maximum outside diameter of the light emitting part is 9.5 mm;

the distance between the electrodes is 1.5 mm;

the inside volume of the arc tube is 75 mm$^3$;

the wall load is 1.5 W/mm$^2$;

the rated voltage is 80 V; and the rated wattage is 150 W.

Installation of this discharge lamp in the above described projector device or a presentation apparatus, such as an overhead projector, can offer radiant light with good color reproduction.

Figure 2A:
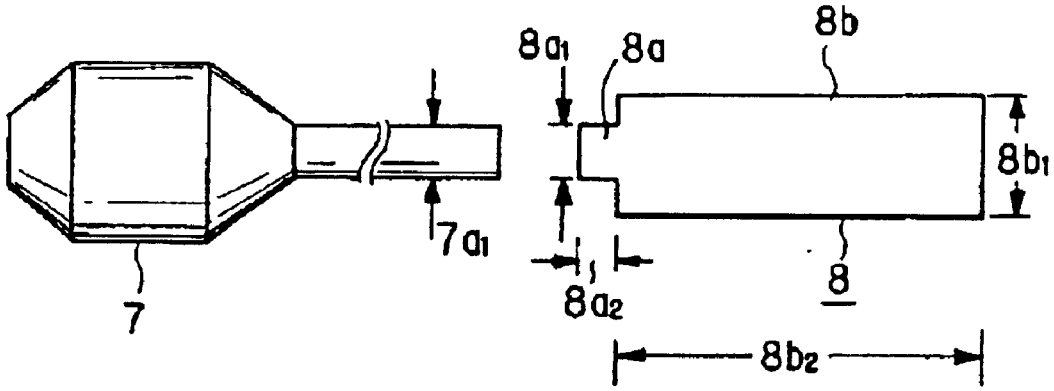
FIGS. 2A to 2C schematically show the metal foil and the electrode of an ultrahigh pressure discharge lamp of the short arc type in accordance with the invention, respectively, prior to assembly, after assembly and in a cross-sectional view along line A–A' of FIG. 2B.
Figure 2B:
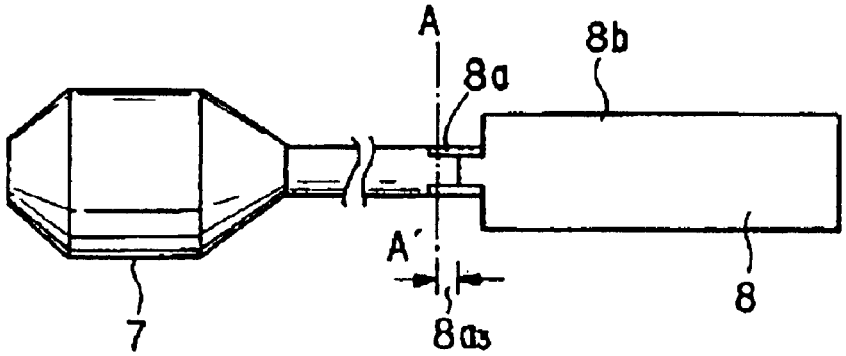
Figure 2C:
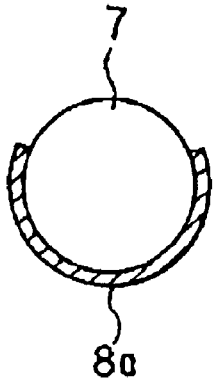

FIGS. 2A to 2C are enlarged views of the anode and the metal foil of the discharge lamp in accordance with the invention. FIG. 2A shows the state of the anode 7 and the metal foil 8 before they are joined to one another. FIG. 2B schematically shows the state after the anode 7 and the metal foil 8 have been joined to one another. FIG. 2C is a cross section take along line A–A' in FIG. 2B.

The metal foil 8 has an essentially rectangular overall shape. However, in the area in which it is connected to the electrode 7, an area 8*a* is formed in which the width has been reduced according to the diameter of electrode 7. This means that the metal foil 8 has an area with a reduced width 8*a* and an area otherwise with a greater width 8*b*. The width $\mathbf{8}a_1$ of the area with the reduced width 8*a* is only slightly larger than the outside diameter $\mathbf{7}a_1$ of the anode 7. As is shown in FIGS. 2B and 2C, the area with the reduced width 8*a* cradles the outside of the electrode 7 after the two have been joined to one another.

Figure 10:
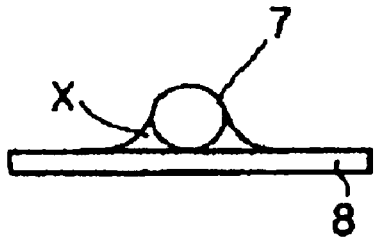
FIG. 10 (Prior Art)
FIG. 10 is a schematic representation of the joined state of a metal foil to an electrode of a conventional ultrahigh pressure discharge lamp of the short arc type.

This arrangement essentially completely eliminates, or at least dramatically diminishes, the gap X at the connecting site of the anode 7 to the metal foil 8 shown in FIG. 10. As a result, cracks which form proceeding from this gap X can be advantageously prevented.

FIGS. 2A to 2C show embodiments of a connection of the anode 7 to the metal foil 8. However the invention, i.e., the measure of arranging the area with a reduced width at the tip of the metal foil, can also be used for connecting the cathode 6 to the metal foil 8.

The numerical values are described below by way of example with respect to the arrangement shown in FIGS. 2A to 2C.

The diameter of the axial part 7*a* of the anode 7 is selected from a range from 0.3 mm to 1.5 mm and is, for example, 0.8 mm. The width $\mathbf{8}a_1$ of the area with a reduced width 8*a* of the metal foil 8 is selected from the range from 0.3 mm to 1.6 mm and is, for example, 1.0 mm. The lengthwise direction $\mathbf{8}a_2$ of the area with the reduced width 8*a* is selected from the range from 2.0 mm to 6.0 mm and is, for example, 4.0 mm. The area $\mathbf{8}a_3$ of the lengthwise direction $\mathbf{8}a_2$ which is in contact with the anode 7 is selected from the range from 1.0 mm to 4.0 mm and is, for example, 2.0 mm. The width $\mathbf{8}b_1$ of the area with a larger width 8*b* of the metal foil 8 is selected from the range from 1.0 mm to 4.0 mm and is, for example, 1.5 mm. The length in the lengthwise direction $\mathbf{8}b_2$ is selected from the range from 8.0 mm to 30.0 mm and is, for example, 11.0 mm. The thickness of the metal foil 8 is selected from the range from 10 microns to 40 microns and is, for example, 20 microns. The thickness of the area with the reduced width 8*a* and the thickness of the area with the greater width are identical to one another.

With respect to current supply of the metal foil 8 with the anode, it is desirable for the width of the area with the reduced width 8*a* to be large. Furthermore, to prevent formation of the above described gap, it is desirable for the anode to be wrapped around by the metal foil to an extent of at least half the circumference as shown in FIG. 2C. It is even more desirable for the metal foil to be wound by at least 7/10 (numerator: length which is shown by $\mathbf{8}a_1$. Denominator: circumference $\mathbf{7}a_1$) of the circumference of the anode.

With respect to the relation between the lengthwise direction of the area with the reduced width 8*a* and the anode 7 (axis), it is desirable that the anode 7 be within the area with the reduced width 8*a*, i.e., that the end of the anode 7 not reach as far as the area with the greater width 8*b* of the metal foil. This is because, in this area, a gap will inevitable form when the end of the anode extends beyond the area with a reduced width 8*a* as far as the area with the greater width 8*b*.

Figure 3A:
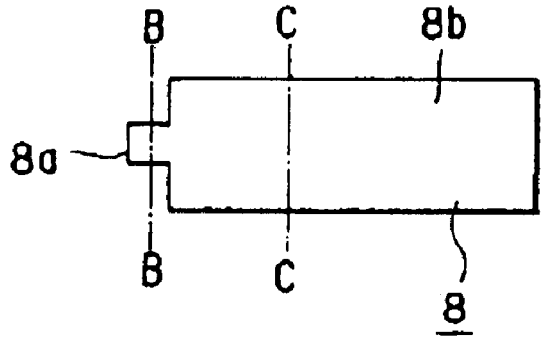
FIGS. 3A to 3D schematically show the metal foil of an ultrahigh pressure discharge lamp of the short arc type in accordance with the invention, respectively, in a plan view, in a cross-sectional view along line B—B of FIG. 3A, in a cross-sectional view along line C—C of FIG. 3A, and in a cross-sectional view along line C—C of FIG. 3A for an alternative cross-sectional shape.
Figure 3B:
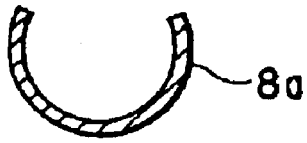
Figure 3C:
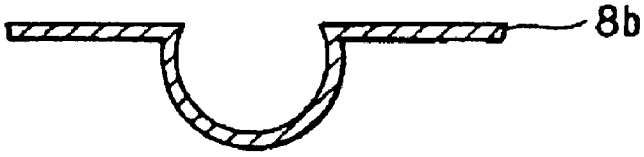
Figure 3D:
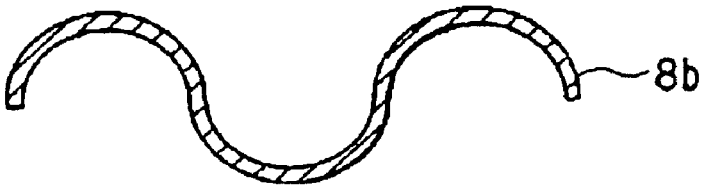

FIGS. 3A to 3D each show the metal foil 8 before it is welded to the electrode. FIG. 3A shows the overall arrangement of the metal foil 8 and shows the state in which the arrangement shown in FIG. 1 is viewed from the direction perpendicular to the page of the drawing. FIG. 3B shows a cross section of the area with a reduced width 8*a* and shows a cross-sectional shape along line B—B in FIG. 3A. FIG. 3C shows a cross section of the area with the greater width 8*b* and corresponds to at section line C—C in FIG. 3A. FIG. 3D shows another embodiment as an alternative of FIG. 3C. Here, a cross section different from FIG. 3C is shown, i.e., one that is W-shaped instead of Ω-shaped.

Since the area with a reduced width 8*a*, as was described above, is connected such that it wraps around the electrode, it is possible to make it curved prior to performing the connection work. The area with the greater width 8*b* can, for example, be essentially omega-shaped as is shown in FIG. 3C, or essentially W-shaped, as is shown in FIG. 3D. The advantage of this shape of the area with a greater width is that the curved shape of the area with the reduced width 8*a* can be easily formed and moreover maintained. Furthermore, there is also the effect that when the outer lead is welded to the other end of the metal foil 8, eccentricity of the outer lead can be advantageously prevented. In addition, a more advantageous effect can be achieved by the essentially W-shape shown in FIG. 3D also in the sense of the relationship to the stress which is formed by welding. This point is described in greater detail below.

Figure 4A:
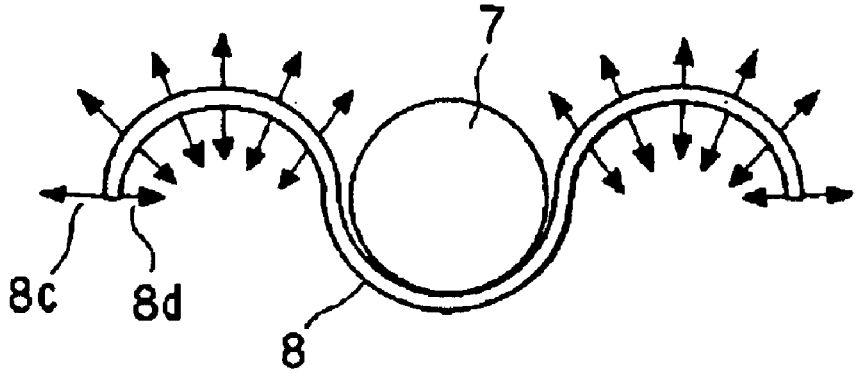
FIGS. 4A & 4B show a schematic representation of the stress formation in the metal foil having a W-shape in accordance with the invention and for a flat foil, respectively.
Figure 4B:
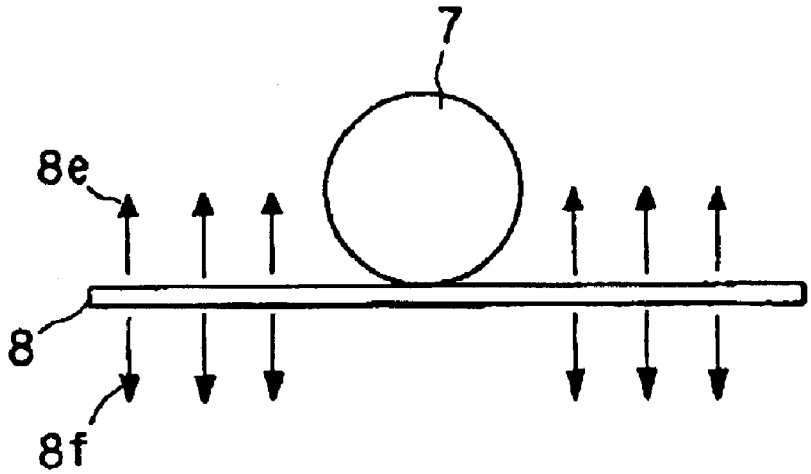

FIGS. 4A and 4B each show formation of a stress in hermetic sealing of the metal foil in silica glass. The silica glass is not shown here, but only the metal foil and the electrode are shown. FIG. 4A is a schematic of the state in the case of using a W-shaped metal foil. FIG. 4B shows a schematic of the state in the case of using a plate-shaped metal foil for comparison purposes.

In the two figures, the metal foil is hermetically enclosed by the silica glass. In the direction perpendicular to the metal foil 8, the stresses shown by the arrows form. These stresses form because the coefficient of expansion of silica glass and the coefficient of expansion of molybdenum differ.

In this case, in FIG. 4A, in molybdenum foil 8, the stresses shown using the arrows 8*c* and the stresses shown using arrows 8*d* are formed. However, some of these stresses act on one another in directions which cancel stresses which form elsewhere. The total stress is therefore reduced. As a result, the adhesive property of the metal foil on the silica glass is maintained in its vicinity. However, in FIG. 4B, the stresses which form in the molybdenum foil and which are shown using arrows 8*e* and the stresses shown using arrows 8*f* are not canceled by stresses which arise elsewhere. The adhesive property of the metal (molybdenum) foil on the silica glass is weakened by the sum of these stresses. As a result, crack formation is caused when the ultrahigh pressure of the discharge space is applied.

The measure that the area with a greater width 8*b* of the metal foil is formed to be essentially W-shaped in the manner shown in FIG. 3D, can reduce formation of a gap as a result of a stress. Furthermore, in the essentially Ω-shape shown in FIG. 3C, the formation of a gap can be reduced even more by the above described cancellation action of the stresses than in a plate-shaped metal foil.

The relation between the area with the reduced width 8*a* and the action is described in addition below.

The metal foil arrangement in accordance with the invention causally prevents or dramatically reduces the formation of a gap due to the above described effect of the area with a reduced width 8*a* in place of the area with the reduced width 8*a*. The shapes of the area with the greater width 8*b* shown in FIGS. 3C and 3D can further reduce gap formation even if an extremely small gap is present.

Such a stress cancellation action in the area with the greater width 8*b* is not limited to the essentially Ω-shape shown in FIG. 3C or to the W-shape shown essentially in FIG. 3D. It goes without saying that it is also possible for other shapes to be used with similar effect.

In the metal foil 8 which is shown in FIG. 3A, for example, for a completely rectangular metal foil an area with a reduced width and an area with a greater width are formed by cutting to size by means of a pressing machine or the like and using a mold means.

Figure 5A:
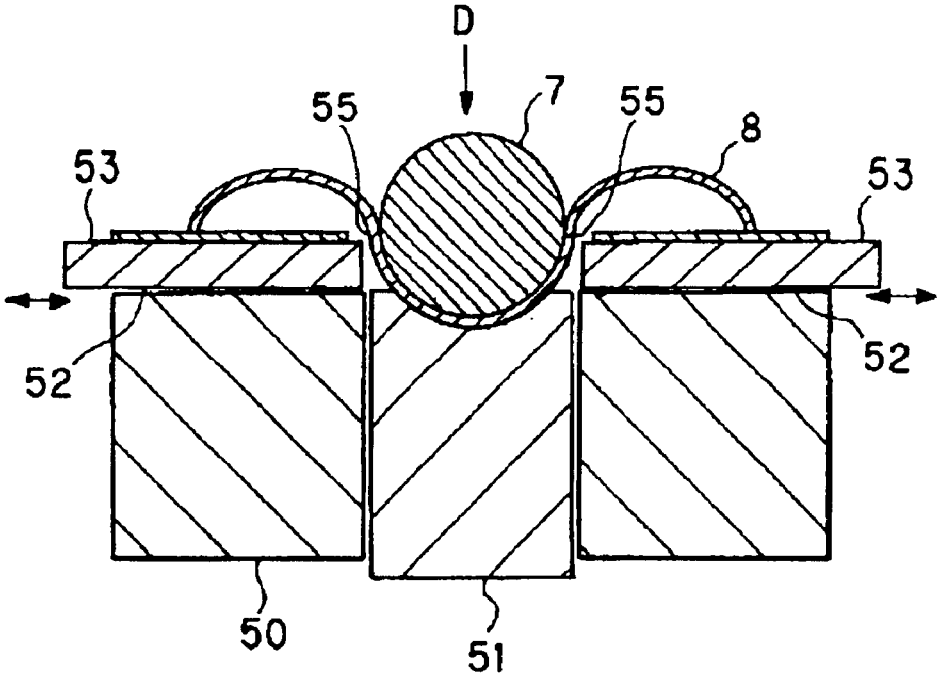
FIGS. 5A & 5B schematically show arrangement of the metal foil and electrode for welding them together in accordance with the invention, in a cross-sectional view along line E—E of FIG. 5B and in a plan view in the direction of arrow D in FIG. 5A, respectively.
Figure 5B:
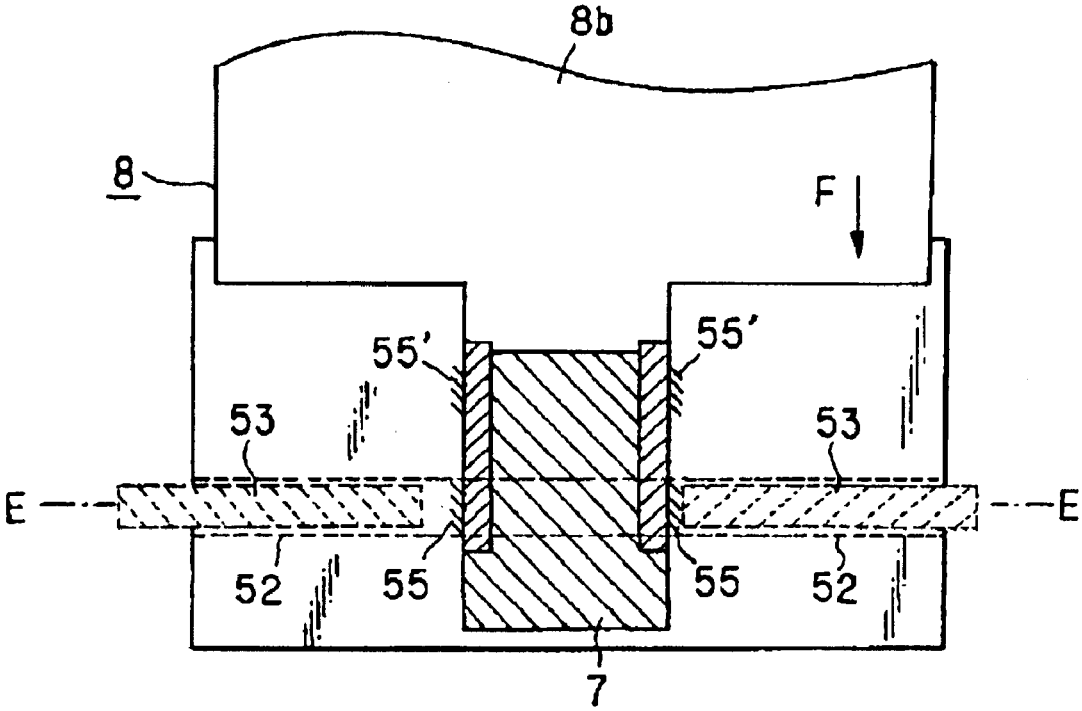

The effort of connecting the metal foil 5 to the electrode 7 is described below. FIGS. 5A and 5B show the state in which the electrode 7 is resistance-welded to the metal foil 8. FIG. 5A shows the state in which the metal foil and the electrode are located in a gauge 50. FIG. 5B shows the state which is viewed from direction D as shown in FIG. 5A. FIG. 5A is a cross section which corresponds to the line E—E in FIG. 5B.

The electrode 7 and the metal foil 8 are placed on a support frame 51 in the gauge 50 in which a given shape is formed. In the gauge 50, on the right and left, passages 52 for a welding rod are formed at two locations. A welding rod 53 is inserted into each passage 52.

By moving the two welding rods 53, i.e., the left welding rod 53 and the right welding rod 53 inward, the electrode 7 and metal foil 8 are welded to one another at the welding points 55 with the metal foil 8 wrapped around the outside surface of the electrode 7.

In the arrangement in accordance with the invention, since welding to the electrode takes place by pressing the welding rods from opposite sides of the electrode, a welding point 55 is formed on the two sides of the electrode at at least two points. In this way, there is a great advantage with respect to compressive strength.

Figure 6A:
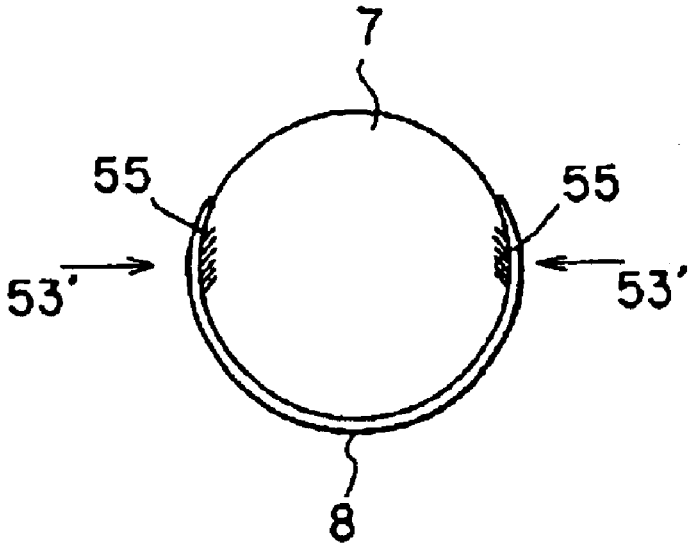
FIGS. 6A and 6B show a the result of welding the metal foil and the electrode of an ultrahigh pressure discharge lamp of the short arc type in accordance with the invention and welding via a conventional process.
Figure 6B:
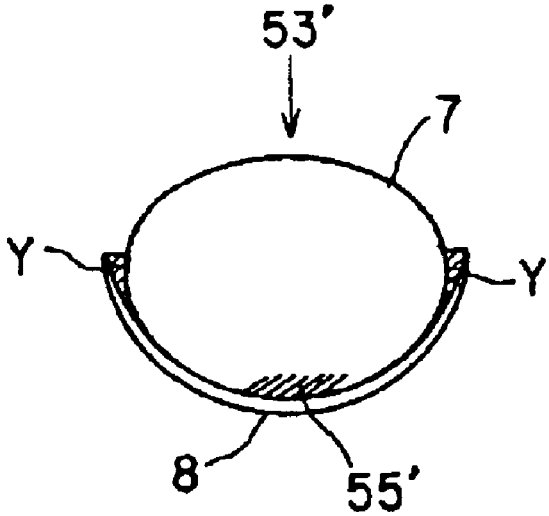
FIG.6B (Prior Art)

FIGS. 6A and 6B each show the advantage which accrues by forming the welding points in the side areas of the electrode. FIG. 6A is an enlargement of the electrode and metal foil after the welding process in accordance with the invention. FIG. 6B shows an enlargement of the electrode and the metal foil according to a conventional welding process for comparison purposes.

In FIG. 6A, the welding rods touch the side areas of the electrode 7, by which the welding points 55 are formed in the two side areas. In FIG. 6B, the welding rods touch the electrode 7 from above and below, by which a welding point 55' is formed at only one point underneath the electrode 7. In FIGS. 6A and 6B reference number 53' labels the direction of pressure by the welding rods.

The difference between the contact directions of the welding rods entails not only the action of increasing the strength by the different number of welding points. In FIG. 6B, the electrode itself is deformed after welding such that it widens to the right and left due to the pressing of the welding rod. More often, this deformation forms a gap Y between the metal foil and the electrode. On the other hand, in FIG. 6A the direction of pressing of the welding rods is different, resulting in the action that formation of such an undesirable gap is advantageously suppressed.

Here, it is desirable for the surface of the welding area (weld point) 55 to be less than or equal to 0.3 $mm^2$ when the metal foil is welded to the electrode. The reason for this is the following:

In the welding area, a state is produced during welding in which the tungsten of which the electrode is made is alloyed with the molybdenum of which the metal foil is made. This alloyed state produces a different coefficient of expansion relative to the molybdenum part in the vicinity of the welding area. This difference between the coefficients of thermal expansion produces the so-called foil floating phenomenon in this welding area.

For this numerical value, the optimum value will vary depending on the different conditions, such as the material of the electrode, the material of the metal foil, dimensions, the arrangement of the discharge lamp and the like. Strictly speaking, the numerical value of only the welding area cannot easily be fixed. However, the discharge lamp in accordance with the invention is used as a light source of a projector or the like. The general dimensions and specification conditions are largely limited. Furthermore, it was found that, in the area of these normally fixed conditions, the welding area has a great effect on the pressure tightness. It has been stated that specifically a welding area of, for example, less than or equal to 0.3 $mm^2$ is excellent when the outside diameter of the axial part of the electrode is within the range from 0.2 mm to 1.0 mm and the width of the area with a greater width of the metal foil is within the range from 1.0 mm to 4.0 mm.

In FIG. 5B, after forming the welding points 55, by moving the assembly of the metal foil and the electrode in the direction F, in addition, other welding points 55' are formed. By increasing the number of welding points, in this way, stronger joining of the electrode to the metal foil is achieved; this also leads to better prevention of detachment of the metal foil after welding. Since this measure does not mean an increase of the area of the welding region, as was described above, the above described foil floating phenomenon can be prevented and a solid connection can be enabled.

Figure 7:
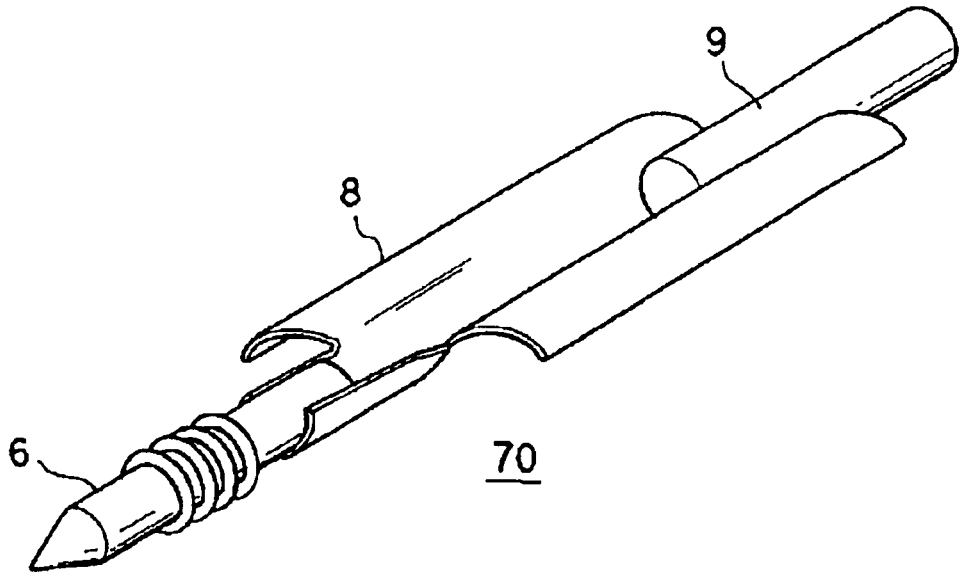
FIG. 7 shows a schematic of the electrode assembly of an ultrahigh pressure discharge lamp of the short arc type in accordance with the invention.

FIG. 7 shows an electrode assembly 70 after completion of the above described welding process. The outer lead 9 can be welded to the metal foil 8 such that the side areas of the outer lead are welded in the above described manner. However, welding from the top and bottom in the conventional manner can also be performed. This is because formation of a gap need not be considered in conjunction with the emission space when the outer lead is welded to the metal foil.

In the electrode assembly 70 which has been completed in this way, the electrode 6, the metal foil 8 and the outer lead 9 are formed in succession. The electrical connection is also complete here. In the next process, this electrode assembly 70 is placed in the light emitting part and in the side tube part of silica glass which has been shaped into the form of a side tube part, hermetically sealed and, for example, subjected to a shrink seal.

The above described connecting arrangement of the metal foil to the electrode is not limited to the anode, but can also be used for the cathode.

As the arrangement of the electrode there is an electrode form comprised of a part with a larger diameter of the tip and of an electrode rod which supports it, like the electrode shown in FIG. 1, and an electrode form which extends as the electrode rod with the same diameter unchanged as far as the tip, like the cathode shown in FIG. 1. However, the connecting arrangement of the metal foil to the electrode in accordance with the invention can also be used for an electrode with any arrangement, without regard to whether the anode or the cathode is involved.

The arrangement in accordance with the invention can be used both for a discharge lamp of the direct current operating type and also for a discharge lamp of the alternating current operating type.

Figure 8:
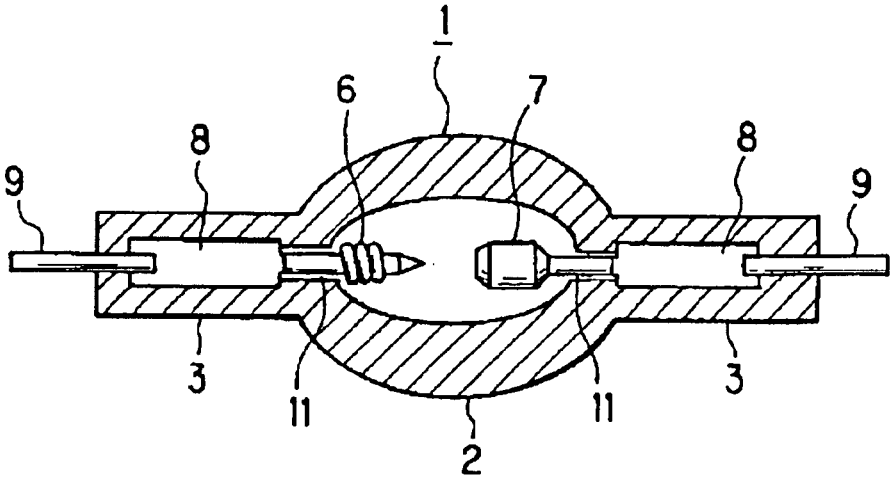
FIG. 8 shows a schematic of another embodiment of the ultrahigh pressure discharge lamp of the short arc type in accordance with the invention.

FIG. 8 schematically shows the arrangement of a discharge lamp in which an extremely small gap is formed between the electrode and the side tube part, and furthermore, shows the state in which the connecting arrangement of the metal foil to the electrode in accordance with the invention is used. The light emitting part is filled with at least 0.15 mg/cm$^3$ mercury, and on the outside surface in the side tube part 3 of the cathode 6 and in the side tube part 3 of the anode 7 a gap 11 is formed. The reason for this gap is the following:

When the electrodes are made of tungsten and the side tube parts of silica glass and they are located directly tightly adjoining one another, there is the danger that, as a result of the difference between the coefficient of expansion of the two, cracks form after the process of hermetic sealing. The gap 11 is therefore formed to make it possible for the two to expand freely in relative terms. The gap has a width from roughly 5 microns to 20 microns.

In a discharge lamp with such an arrangement, the high pressure within the light emitting part acts directly on the connecting site of the electrode to the metal foil. It is therefore extremely useful to use the metal foil arrangement in accordance with the invention in which the compressive strength can be increased.

Figure 9:
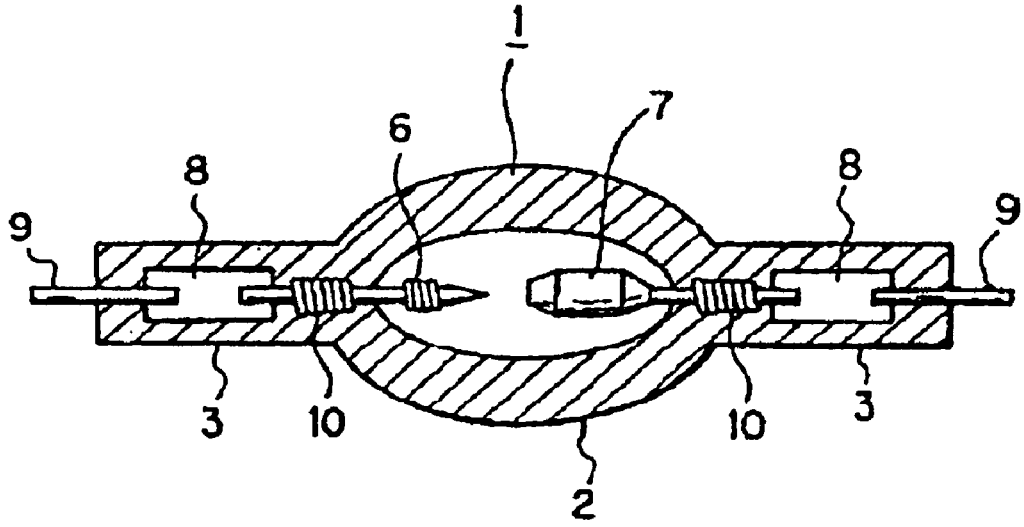
FIG. 9 (Prior Art)
FIG. 9 a cross-sectional view of a conventional ultrahigh pressure discharge lamp of the short arc type.

The numerical values of the discharge lamp of the short arc type in accordance with the invention are described below by way of example:

Outside diameter of the side tube part: 6.0 mm
Total length of the lamp: 65.0 mm
Length of the side tube: 25.0 mm
Inside volume of the arc tube: 0.08 cm$^3$
Distance between the electrodes: 2.0 mm
Rated luminous wattage: 200 W
Rated luminous current: 2.5 A
Amount of mercury added: 0.25 mg/mm$^3$
Rare gas: 100 torr (13.3 kPa) argon The test result which shows the action of the invention is described below. The discharge lamp 1 has the connecting arrangement shown in FIGS. 2A to 2C, in which the area with a greater width of the metal foil has a W-shaped cross section. The discharge lamp 2 has an arrangement in which the metal foil has a W-shaped cross sectional shape, in which the metal foil, however, does not have an area with a reduced width, but only the area with the greater width. In the discharge lamp 3, the metal foil has a plate-like, rectangular shape, specifically the shape shown in FIG. 4B and in FIG. 9.

The arrangements, otherwise, are basically identical to one another. Each of these discharge lamps 1, 2, and 3 were operated at a rated wattage of 200 W, 1000 pieces, and a pressure tightness test was run, and the results are described below.

In the discharge lamp 1, after 400 hours of operation, no cracks formed and no damage was done to the side tube parts. In the discharge lamp 2, likewise after 400 hours of operation, there were cracks or damage to the side tube parts in 30%. In the discharge lamp 3, within 10 hours of operation cracks formed and damage to the side tube parts occurred in almost 100%.

It becomes apparent from these experimental results that crack formation and damage of the side tube parts are most effectively prevented by the width of the metal foil in the area welded to the electrode being reduced to the size which corresponds to the outside diameter of this electrode and that, moreover, the area with the greater width which is not welded to the electrode has a W-shaped cross section.

As was described above, the ultrahigh pressure mercury discharge lamp of the short arc type in accordance with the invention has an extremely high internal pressure during operation of greater than 150 atm and also extremely strict operating conditions. By the measure that the metal foil has an area with a reduced width and an area with a greater width, that the area with the reduced with has a small width is matched to the electrode axis, and that it wraps around the outside surface of the electrode, when the metal foil is welded to the electrode in this area with a reduced width, the conventionally unavoidable crack can be dramatically diminished.

Furthermore, connection of the electrode to the metal foil in the side tube part makes it possible to arrange several connecting sites with a good balance. Furthermore, the formation of a gap as a result of deformation of the electrode during welding can also be prevented.

In addition, the stresses which form due to the welding can be reduced such that they cancel one another by the measure that the area with a greater width of the metal foil is formed to be essentially Ω-shaped or essentially W-shaped. Therefore, unwanted formation of a gap can be reduced even more.

What is claimed is:

1. Ultrahigh pressure discharge lamp of the short arc type, comprising:

a light emitting part in which a pair of electrodes are disposed opposite each other and which is filled with at least 0.15 mg/mm$^3$ mercury; and side tube parts which extend from each side of the light emitting part and in each of which a respective one of the electrodes is partially hermetically sealed and is connected to a metal foil, wherein each respective metal foil has a first portion which is connected to an end portion of the respective electrode and a remaining portion, said first portion extending from said second portion, wherein the width of the first portion is smaller than width of the remaining portion of the metal foil, and wherein the width of the first portion is sufficient to as at least partially wrap around an outside surface of the respective electrode.

2. Ultrahigh pressure discharge lamp of the short arc type in accordance with claim 1, wherein the metal foil is welded to the electrode.

3. Ultrahigh pressure discharge lamp of the short arc type in accordance with claim 2, wherein the metal foil is welded to the electrode at least at two welding sites which are located at opposite sides of the electrode.

4. Ultrahigh pressure discharge lamp of the short arc type in accordance with claim 3, wherein the welding sites each have a weld area of at most 0.3 mm$^2$, wherein the electrode has an outside diameter from 0.2 mm to 1.0 mm in an area in which the electrode is connected to the metal foil and the width of the remaining portion 1.0 mm to 4.0 mm.

5. Ultrahigh pressure discharge lamp of the short arc type in accordance with claim 1, wherein the electrode is spaced from the remaining portion of the metal foil.

6. Ultrahigh pressure discharge lamp of the short arc type in accordance with claim 1, wherein the first portion of the metal foil wraps at least halfway around the outside periphery of the electrode.

7. Ultrahigh pressure discharge lamp of the short arc type in accordance with claim 1, wherein the first portion of the metal foil wraps around at least 7/10 of the outside surface of the electrode.

8. Ultrahigh pressure discharge lamp of the short arc type in accordance with claim 1, wherein part of the remaining portion partially surrounds the outside surface of the electrode.

9. Ultrahigh pressure discharge lamp of the short arc type in accordance with claim 1, wherein the remaining portion of metal foils have an essentially Ω-shaped cross section.

10. Ultrahigh pressure discharge lamp of the short arc type in accordance with claim 1, wherein the remaining portion of the metal foils have an essentially W-shaped cross section.

11. Ultrahigh pressure discharge lamp of the short arc type in accordance with claim 1, wherein the first portion wraps only part way around the electrode.

12. Ultrahigh pressure discharge lamp of the short arc type in accordance with claim 1, wherein the first portion wraps only slightly more than halfway around the electrode.

* * * * *